United States Patent [19]

Mayer et al.

[11] Patent Number: 4,772,171

[45] Date of Patent: Sep. 20, 1988

[54] PROCESS AND DEVICE TO FEED CONICAL TUBES TO THE PIRN HEADS OF A TEXTILE MACHINE

[76] Inventors: Walter Mayer, Klingenstrasse 9, 8070 Ingolstadt; Johann Hahn, Fruehlingstrasse 3, 8079 Buxheim; Rupert Karl, Thomastrasse 13a, 8070 Ingolstadt, all of Fed. Rep. of Germany

[21] Appl. No.: 917,008

[22] Filed: Oct. 9, 1986

[30] Foreign Application Priority Data

Oct. 16, 1985 [DE] Fed. Rep. of Germany ..... 3536818

[51] Int. Cl.[4] ..... B65H 67/06

[52] U.S. Cl. ..... 414/125; 198/468.7; 242/35.5 A; 414/786

[58] Field of Search ..... 414/112, 125, 786; 57/270; 198/468.7, 468.9; 242/35.5 A; 209/927

[56] References Cited

U.S. PATENT DOCUMENTS

| | | | |
|---|---|---|---|
| 2,543,931 | 3/1951 | Peterson | 242/35.5 A |
| 3,199,652 | 8/1965 | Kilner et al. | 198/468.7 X |
| 4,066,218 | 1/1978 | Kamp | 242/35.5 A |
| 4,564,123 | 1/1986 | Noshi | 221/11 |
| 4,655,665 | 4/1987 | Lattion | 242/35.5 A X |
| 4,688,735 | 8/1987 | Shinji et al. | 414/128 X |

FOREIGN PATENT DOCUMENTS

| | | | |
|---|---|---|---|
| 2131957 | 2/1973 | Fed. Rep. of Germany | 242/35.5 A |
| 2816418 | 10/1979 | Fed. Rep. of Germany | 242/35.5 A |
| 2543931 | 10/1984 | France | 242/35.5 A |
| 56-61275 | 5/1981 | Japan | 242/35.5 A |
| 58-139978 | 8/1983 | Japan | 242/35.5 A |

*Primary Examiner*—Leslie J. Paperner

*Attorney, Agent, or Firm*—Dority & Manning

[57] ABSTRACT

The tubes to be conveyed to the pirn heads are stacked up within each other in columnar fashion, are held in readiness at a supply location and are separated to be taken away. The separated tube is brought into a conveying position and, while maintaining this conveying position, is transferred to a conveyor extending across all of the pirn heads of the machine. For this purpose a tube-conveying device is installed between a tube magazine (4) and a conveyor belt (2) extending alongside all of the pirn heads, containing means (51) to position the tube (50) into the conveying position and means (71, 6, 8) for the transfer of the tube (5) in its conveying position to the conveyor belt (2).

19 Claims, 4 Drawing Sheets

PROCESS AND DEVICE TO FEED CONICAL TUBES TO THE PIRN HEADS OF A TEXTILE MACHINE

BACKGROUND OF THE INVENTION

The instant invention relates to a process for the feeding of conical tubes to the pirn heads of a textile machine, whereby tubes, stacked up within each other in columns, are kept at a storage location and are separated from each other for withdrawal, as well as a device to carry out the said process.

It has previously been proposed to stack conical tubes within each other to constitute tube columns or stacks, to store these tube columns in a rotatable supply container and to separate the tubes one after the other from the column by means of a separating device (DE-PS 2.131.957). The known proposal contains no detailed indications as to the subsequent handling of the separated tubes.

SUMMARY OF THE INVENTION

It is the task of the instant invention to create a process and a device making it possible to feed the tubes separated from a tube column to the pirn heads in a simple manner and in the position required for tube replacement.

A process is carried out according to the invention by bringing each separated tube into a conveying position and by transferring it to a magazine extending alongside all of the pirn heads while maintaining its conveying position.

A further variant of the process provides for the tube to be stripped from a vertically positioned tube column in the direction of its conically downward tapering end, to be repositioned from its vertical position to a horizontal position, in which position it is then transferred to the magazine. The tubes are preferably transferred to the magazine in successive order until tubes have been transferred for all of the magazine's supply locations, whereupon the magazine returns to its initial position.

The device to carry out the process with a tube magazine containing least one column consisting of conical tubes stacked up within each other and with a device for the separation of the tubes, is characterized in that a device for the conveying of a separated tube is installed between the tube magazine and a conveyor belt extending across all of the pirn heads, said conveying device containing means for repositioning the tube to a conveying position and means for the transfer of the tube, in said conveying position, to the conveyor belt.

In a space-saving arrangement of the vertical tube column the transfer of the tube in horizontal conveying position is preferably effected by means of an arc-shaped tube slide located after the tube magazine and ending at a horizontal tube depositing table. Provisions are made here for transferring means to be installed at the tube depositing table for the transfer of a tube to an ascending conveyor followed by a grabber which transfers the tube to the conveyor belt.

In a further variant of the invention, the table on which the tubes are deposited is equipped with stops which maintain the position of each tube. Preferably, the hindmost stop, in the sliding direction of the tube, is equipped with means to dampen the impact of the tube. The tube is prevented from bouncing back to the tube slide simply through the fact that the foremost stop, in the sliding direction of the tube, is constituted by the tube slide itself.

Secure and gentle grasping of the conical tube is ensured by fashioning the transfer means of the tube depositing table in the form of swivelling bows. The bows are preferably attached to a rotatably supported pillow block. In an advantageous further development of the device, a rotating movement of the pillow block around its axis, resulting in a swivelling movement of the bows, is produced by a lever arm, to which a cam lever is linkingly connected, said lever arm being attached to the pillow block. In a manner that greatly simplifies the device, the swivelling movement of the bows in direction of the ascending conveyor is prompted by a tube carrier of said ascending conveyor, acting upon the cam lever.

To that end the tubes lying on the tube depositing table are transferred to the tube carrier which activates the cam lever. Due to the fact that the bows are adjustable crosswise to the running direction of the ascending conveyor within the pillow block, their position can be changed and adapted to tubes of different conicity and diameter.

BRIEF DESCRIPTION OF DRAWINGS

An embodiment of the invention is described through the following drawings.

DETAILED DESCRIPTION OF DRAWINGS

Figure 1:
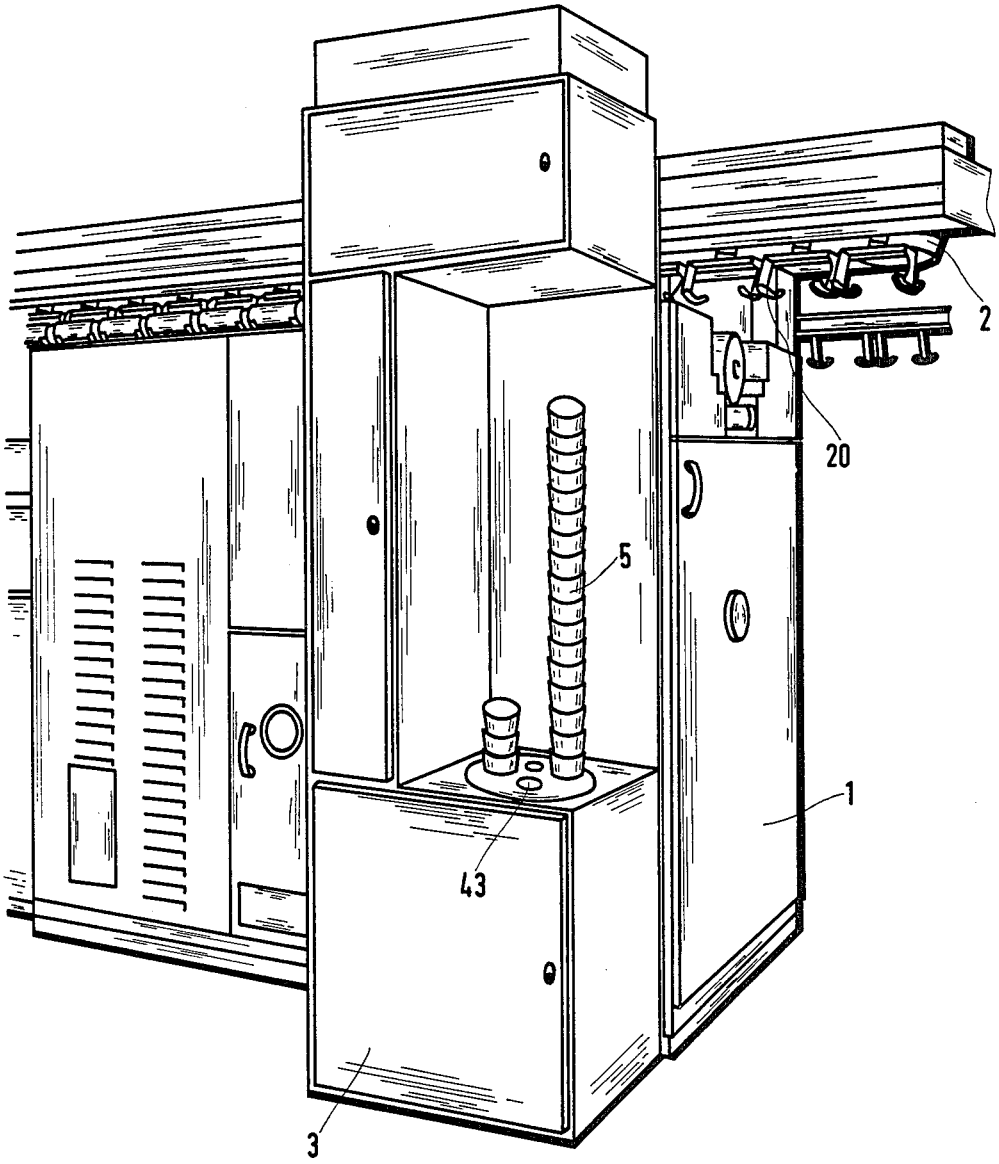
FIG. 1 is a perspective drawing of the machine end of a textile machine equipped with a tube loading station and an endless tube conveyor belt.
Figure 2:
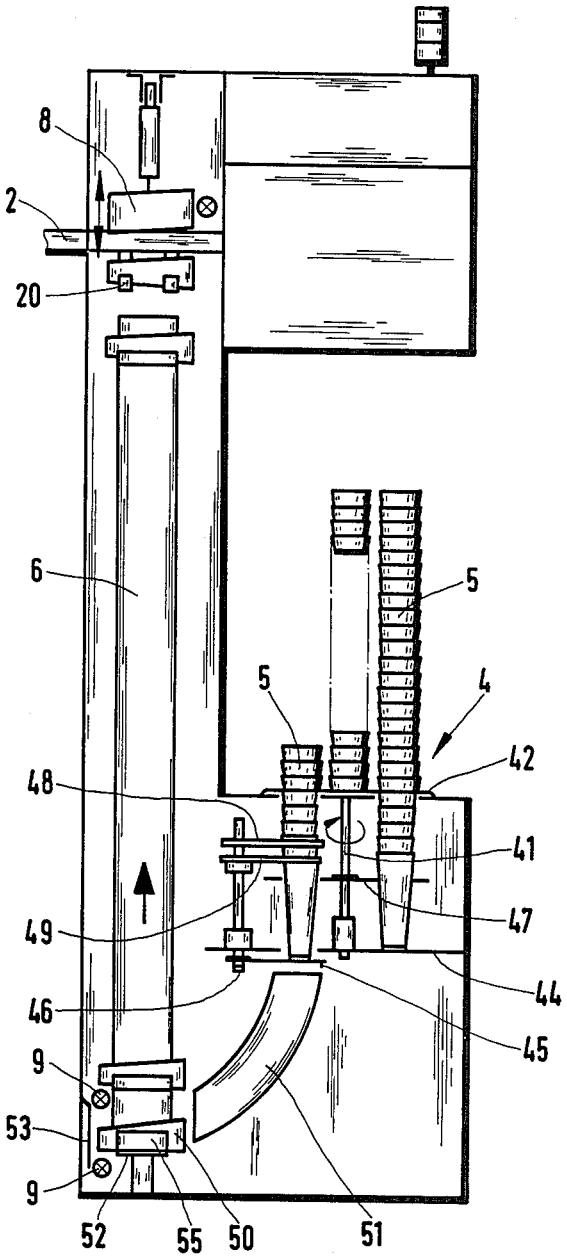
FIG. 2 shows a front view of the tube loading station.

The textile machine 1, for example an open-end spinning machine, of which only an end frame is shown in FIG. 1, is equipped with the customary plurality of work stations, each with a winding device for the winding of yarn on a tube. The individual winding devices are supplied with empty tubes by means of a conveyor belt 2 equipped with tube holders 20, located above the pirn heads. The tubes are positioned with their tapered end in the longitudinal direction of the machine and are laid into the tube holder 20. A fixed tube loader, located within a housing 3 at one end of machine 1 is attributed to the conveyor belt 2. The tube loader contains a tube magazine, designated throughout with the number 4, which accepts at least one tube stack or column 5. The tube column 5 consists of tubes 50 stacked up within each other and standing in the tube magazine 4, whereby the conically tapered ends of the tubes point in the direction of the tube column's break-up, i.e. downward in the embodiment shown. In this embodiment, the tube magazine 4 is constituted by a horizontal rotating plate 42 attached to a rotating shaft 41 and provided with several output openings 43, arranged in an orbit, through each of which a tube column 5 emerges (FIGS. 1 and 2). The rotating shaft 41 is fixedly attached to and standing upon ground plate 44.

One of the tube columns 5 stands on a support in the form of a bottom plate 45 swivelling out of the vertical plane of said tube column 5 and attached to a rotatably supported and driven shaft 46. The tube columns 5 which remain in storage rest on a fixed bottom plate 44 and can be shifted one after the other upon the swivelling bottom plate 45 through the rotation of the rotating plate 42. To improve the stability of tube column 5, an additional rotating plate 47, equipped with output openings is attached on the rotating shaft 41 between the rotating plate 42 and the bottom plates 44 and 45, at the height of the last tube of tube column 5. At the same time the last tube of each tube column 5 to be distributed is guided with precision by the second rotating plate 47.

The tube column 5, standing on the swivelling bottom plate 45, is provided with a device for the separation of the tubes stacked up within each other, said device being located on a rotating shaft 46 and containing a fixed tube clamp 481 working together with a movable tube clamp 48 to clamp and hold the next-to-last tube and a tube stripper 49, attached on a vertically movable rotating axis 46 to strip off the last tube from the tube column 5.

The two clamp jaws 48 and 481 are located on a storage plate 482 amd the clamp jaw 48 can be swivelled around an axis 483 located on the support plate 482. The swivelling motion can, for example, be effected by means a compressed air cylinder 484 whose piston rod is connected to a cog located on the clamp jaw 48.

The tube stripper 49 is attached on a rotating shaft 46 which rotates within the fixed clamp jaw 481 and within a strap 462, connected to the piston rod of a compressed air cylinder 461. A compressed air cylinder 491 the piston rod of which is connected to a cog on the tube stripper 49 causes the rotation of axis 46 and thereby the movement of the tube stripper 49 in direction of the tube column as well as the swivelling of the bottom plate 45 away from the tube column 5.

The vertical movement of shaft 46, in the course of which the strap 462 is pressed against the stop rings on shaft 46, is effected by means of a compressed air cylinder 461 whose piston rod is connected to strap 462. During the downward movement the tube stripper 49 attached to shaft 46 presses against the upper tube edge of the last tube 50 and then strips it from the tube column.

Little clamping pressure is sufficient to hold the next-to-last tube by means of the clamping jaws 48 and 481 since this next-to-last tube moves with its conically widening diameter into the clamping jaws 48, 481 and wedges itself in under the influence of the axial load force in the direction in which the tube is stripped off and which may exceed the clamping force of the clamping jaws upon the tube. Damage to the tubes is thereby avoided. The last tube of the tube column is detached from said tube column in an equally gentle manner by the tube stripper 49 which is applied without impact on the edge of the tube.

Figure 3:
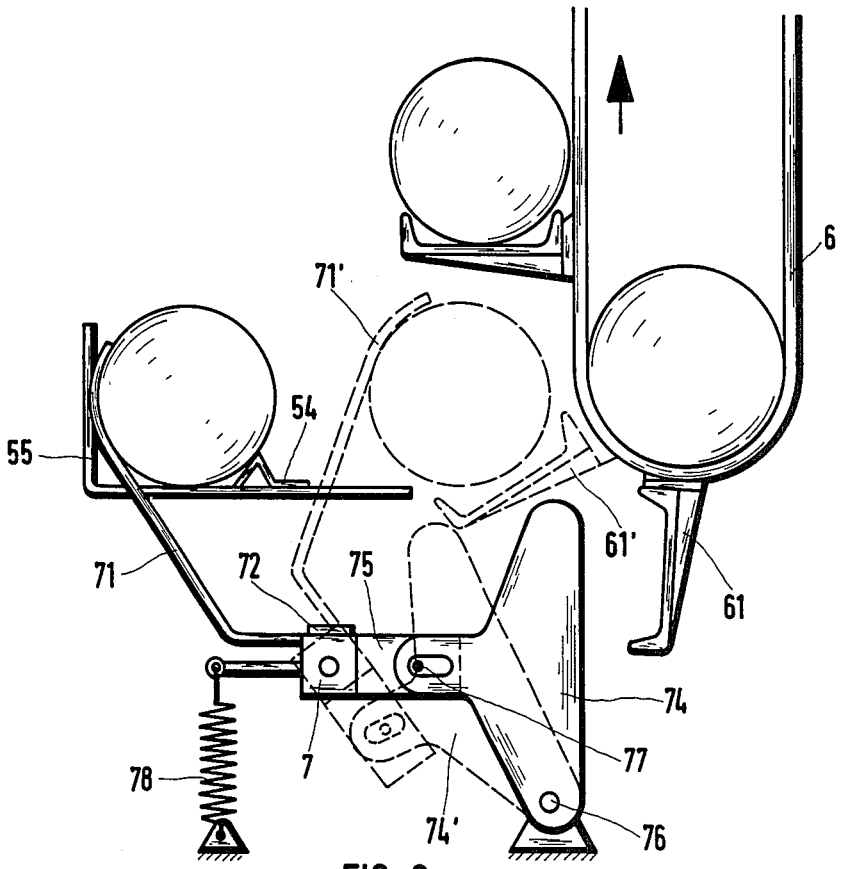
FIG. 3 shows a side view of a tube depositing table with transfer means and an ascending conveyor.

A conveying device is located between the tube magazine 4 and the conveyor belt 2 and brings tube 50 which is detached from the tube column 5 into a conveying position and feeds it to the conveyor belt 2 in that conveying position. The conveying device is equipped with a tube slide 51 beneath the swivelling bottom plate 45, said slide being curved in the direction of a tube depositing table 52 which is fixedly supported under and laterally of the tube magazine 4 and ends on said table. The rising trunk of an ascending conveyor 6 passes in proximity of the tube depositing table 52, the tube carrier 61 (FIG. 3) of said ascending conveyor being oriented in the same direction as a tube 50 lying on the tube depositing table 52. The tube depositing table 52 is equipped with transfer means for the transfer of a tube 50, deposited on said tube depositing table 52 and extending laterally beyond it, to one of the tube carriers 61 of the ascending conveyor 6.

Figure 4:
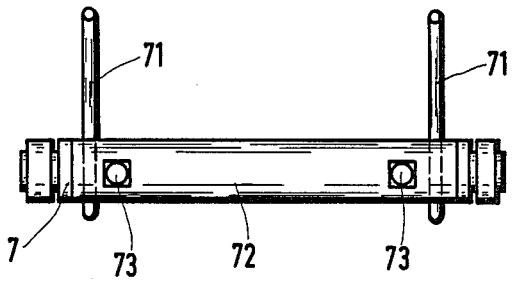
FIG. 4 shows a top view of a pillow block with bows attached thereto.
Figure 5:
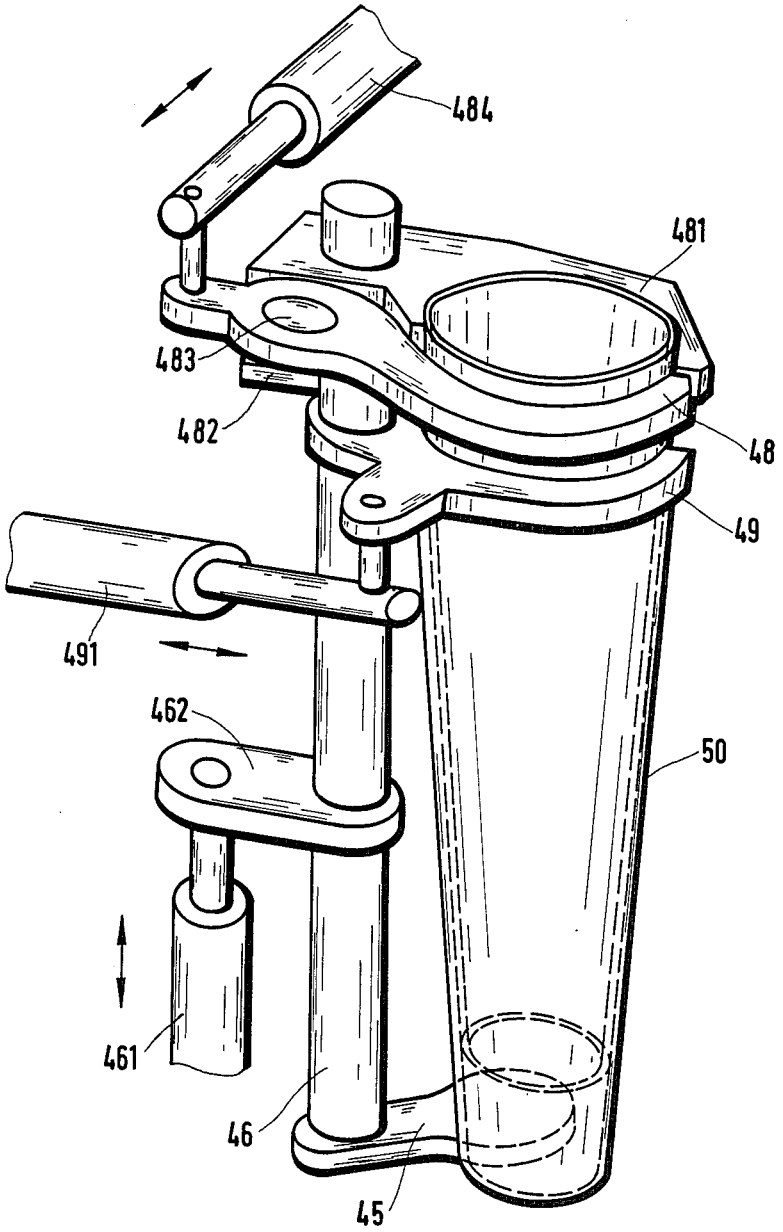
FIG. 5 shows a perspective view of the device for separation of the tubes stacked up within each other.

The transfer means are constituted by two bows 71 on either side of the tube depositing table 52, so that these are able to grasp a tube 50 lying on said table near their two ends. The bows 71 are clamped and held by means of a clamping bar 72 in a pillow block 7 and, upon loosening of screws 73, can be shifted within the pillow block in the direction of the ascending conveyor 6 and in the opposite direction (FIG. 4). The clockwise rotation of the pillow block 7, imparting a swivelling motion to the bows 71 in direction of the ascending conveyor 6, is effected by means of a cam lever 74 engaging a lever arm 75 which is attached to the pillow block 7 and which is pressed by one of the tube carriers 61 of the ascending conveyor 6 from its initial position of FIG. 3 into position 74', indicated by broken lines. For this purpose, cam lever 74 is made to swivel around an axis 76 and is linkingly connected to lever arm 75 by means of a bolt 77 attached on the lever arm 75 and engaging an elongated opening on the cam lever.

In operation, always the last tube is first taken from the tube column 5 standing on the swivelling bottom plate 45 above the tube slide 51. To accomplish this, the next-to-last tube of the tube column 5 is held by tube clamps 48 and 481, the bottom plate 45 is swivelled away from the tube column 5 and the last tube is stripped off from the tube column 5 by the tube stripper 49 which attacks at the upper tube edge. This tube 50 falls, conically tapered end forward, upon the arc-shaped tube slide 51 and slides downward on it, whereby its vertical position at first changes into an oblique position and finally into a horizontal position as the tube reaches the tube depositing table 2.

As it slides upon the tube depositing table 52, tube 50 is stopped by stop 53 at its tapered end, it being possible to cover said stop with a material that dampens the impact of the tube. The tube 50 is prevented from bouncing back on the slide simply through the installation of the tube depositing table 52 at a somewhat lower level than the tube slide 51, so that, as can be seen in FIG. 2, the outlet edge of the tube slide 51 itself constitutes a stop for the tube 50. The tube depositing table 52 is furthermore equipped with a stop 54 for the tube 50, said stop having a contact surface inclined in direction of the ascending conveyor 6, preventing said tube 50 from rolling away in that direction. A vertical wall 55 of the tube depositing table 52 or the bows 71 retain the tube 50 in the opposite direction.

The tube 50 thus brought into a conveying position and centered on the tube depositing table 52 on which it lays is then transferred to a tube carrier 61 of the revolving ascending conveyor 6. This occurs as soon as one of the tube carriers encounters the cam lever 74 and pushes it into position 74', whereby pillow block 7 is rotated around its axis via lever arm 75 and whereby the bows 71 are swivelled in direction of ascending conveyor 6, into position 71'. At the same time the bows 71 take along tube 50 and convey it away in a horizontal position over and across stop 54 toward tube carrier 61 which has prompted the swivelling motion of bows 71 and which assumes position 61' for the transfer of the tube. In this manner the tube carriers 61 are continuously supplied with tubes 50 which are then conveyed upwards in a horizontally lying position by the ascending conveyor 6. The tube arriving at the upper end of the ascending conveyor 6 is then grasped by a grabber 8, movable between the ascending conveyor 6 and the conveyor belt 2, which inserts it in its conveying position into a tube holder 20 of the conveyor belt 2. The tubes 50 are transferred successively to the conveyor belt 2, until tubes have been transferred for all the tube holders 20 of the conveyor belt 2. The conveyor belt 2 then returns into its initial position.

The separation of a tube from the tube column 5 and its release by the bottom plate 45 occurs of course only when the tube 50 has gone from the tube depositing table 52 to the tube carrier 61 of the ascending conveyor 6 and when the bows 71 have again been returned to their initial position by a return spring 78 which acts via a lever arm upon pillow block 7, rotating it counterclockwise. This control is effected by means of a light barrier 9 which senses one end of tube 50, extending over the tube depositing table 52.

The embodiment described above can be varied in different ways. For example, a grabber can be provided to grasp the tube which is separated from the tube column, to bring it into conveying position and to insert it directly into a tube carrier 61 of ascending conveyor 6. The tube slide 51 and the tube depositing table 52 with its transfer means 71 could then be omitted.

We claim:

1. A process for supplying conical tubes to the pirn heads of a textile machine, comprising the steps of:

(a) stacking a supply of conical tubes in a vertical column with their longitudinal axes in a vertical plane;

(b) separating the end tube from said column;

(c) transporting said separated tube to a first conveyor and orienting said tube with its longitudinal axis in the horizontal plane;

(d) engaging said separated tube with a portion of said first conveyor with the longitudinal axis of said tube being arranged in a horizontal plane;

(e) transporting said tube in a vertical path by said first conveyor to a second conveyor which has a plurality of tube holders thereon;

(f) transferring said tube to one of said tube holders in a predetermined orientation; and (g) transporting said holder and said tube to a pirn head.

2. A process as set forth in claim 1, wherein said tubes are stacked with their smaller ends in the lower position.

3. A process as set forth in claim 1, wherein said tubes are conveyed by said second conveyor with their longitudinal axis extending in a horizontal plane.

4. A device for supplying conical tubes to the pirn heads of a textile machine, comprising:

(a) means for supporting a column of conical tubes, stacked with their longitudinal axes extending in a vertical plane;

(b) means for separating end tubes from said column;

(c) slide means for transporting said separated tube and for changing its orientation so that the longitudinal axis of said tube lies in a horizontal plane;

(d) a vertically ascending conveyor for transporting said separated tubes vertically, with said tubes lying in a horizontal position;

(e) means for depositing said horizontal tubes on said vertically ascending conveyor;

(f) a horizontal conveyor having a plurality of tube holders for holding said separated tubes in a predetermined orientation;

(g) means for transferring said tubes from said vertically ascending conveyor to empty tube holders on said horizontal conveyor; and (h) means for moving said horizontal conveyor to pirn heads requiring tubes.

5. A device as set forth in claim 4, wherein said slide means is an arcuate shaped tube for receiving said separated tube in a vertical plane and for changing its orientation to the horizontal plane.

6. A device as set forth in claim 5, wherein said slide means deposits said tube onto a horizontal table which is provided with a transfer means for transferring said tube to said vertically ascending conveyor.

7. A device as set forth in claim 6, wherein the horizontal table is provided with stops to locate the horizontal tube thereon in a predetermined position.

8. A device as set forth in claim 7, wherein one of said stops is provided with means to dampen the impact of the sliding tube.

9. A device as set forth in claim 8, wherein said horizontal table is lower than the end of said slide tube and the end of said slide tube constitutes one of said stops.

10. A device as set forth in claim 6, wherein said depositing means comprises two arcuate bars.

11. A device as set forth in claim 10, wherein said bars are attached to a rotatably supported pillow block.

12. A device as set forth in claim 11, wherein a lever arm has one end attached to said pillow block and its other end connected to a cam lever.

13. A device as set forth in claim 12, wherein a tube carrier is disposed on the vertically ascending conveyor and contacts a cam lever to cause said bars and said pillow block to swivel about the longitudinal axis of said pillow block.

14. A device as set forth in claim 13, wherein said conical tube lying on said horizontal table is transferred to said tube carrier which contacted the cam lever.

15. A device as set forth in claim 11, wherein the space between said arcuate bars can be adjusted within the pillow block.

16. A device as set forth in claim 6, wherein said horizontal table is provided with sensors to sense the presence of said conical tube thereon.

17. A device as set forth in claim 16, wherein said sensors are light sensors.

18. A device as set forth in claim 4, wherein said column of tubes is located above the tube slide.

19. A device as set forth in claim 18, wherein a tube stripper is provided for removing the end tube and wherein the next to last tube in said vertical column is held by gripping jaws.

* * * * *